United States Patent [19]

Nishida et al.

[11] Patent Number: 4,735,176

[45] Date of Patent: Apr. 5, 1988

[54] CLOSED EVAPORATIVE COOLING SYSTEM FOR AN ENGINE

[75] Inventors: Tsuyoshi Nishida; Mitsumasa Isoda, both of Sakaishi, Japan

[73] Assignee: Kubota Limited, Osaka, Japan

[21] Appl. No.: 45,196

[22] Filed: Apr. 30, 1987

Related U.S. Application Data

[63] Continuation of Ser. No. 776,871, Sep. 17, 1985, abandoned.

[30] Foreign Application Priority Data

Nov. 14, 1984 [JP] Japan ..... 59-239878

[51] Int. Cl.[4] ..... F01P 9/02

[52] U.S. Cl. ..... 123/41.21

[58] Field of Search ..... 123/41.01, 41.02, 41.08, 123/41.54, 41.21, 41.25; 165/104.32

[56] References Cited

U.S. PATENT DOCUMENTS

| | | | |
|---|---|---|---|
| 1,658,089 | 2/1928 | Mallory | 123/41.21 |
| 1,709,863 | 4/1929 | Modine | 123/41.26 |
| 2,403,218 | 7/1946 | Hammers | 123/41.26 |
| 2,449,110 | 9/1948 | Eells | 123/41.26 |
| 3,077,927 | 2/1963 | White et al. | 123/41.27 |
| 3,171,392 | 3/1965 | Alfieri | 123/41.01 |
| 3,312,204 | 4/1967 | Barlow | 123/41.25 |
| 3,499,481 | 3/1970 | Avrea | 165/104.32 |
| 3,820,593 | 6/1974 | Pabst | 165/104.32 |

FOREIGN PATENT DOCUMENTS 4428022 11/1969 Japan .

*Primary Examiner*—William A. Cuchlinski, Jr.

*Attorney, Agent, or Firm*—Schwartz, Jeffery, Schwaab, Mack, Blumenthal & Evans

[57] ABSTRACT

A closed evaporative cooling system for an engine includes a water jacket having an opening formed through an upper wall of said engine, a condenser having an upper tank, a bottom plate and condenser tubes, a seat formed around said upside opening for fixing said bottom plate of said condenser thereon, a pressure regulating valve for regulating internal pressure of said upper tank, each of said tube has an upper end penetrating through the bottom wall of said upper tank and brazed or soldered thereto, and a lower end penetrating through said bottom plate and brazed or soldered thereto respectively, and the system further includes a damper pipe for damping the variation of internal pressure of said upper tank, having one end communicated with said upper tank of said condenser fixed on the upper part of said water jacket of said engine and another end communicated with said pressure regulating valve.

4 Claims, 3 Drawing Sheets

CLOSED EVAPORATIVE COOLING SYSTEM FOR AN ENGINE

This application is a continuation of application Ser. No. 776,871, filed Sept. 17, 1985, now abandoned.

BACKGROUND OF THE INVENTION

1. Field of the Invention

The present invention related to a closed evaporative cooling system for an engine, comprising a condenser for condensing vapor generated in the water jacket of the engine and introduced in the condenser tubes therefrom, by means of heat exchange between the atmosphere and vapor passing in the condenser tubes.

2. Description of the Related Art

It is known that a closed evaporative cooling system, in which cooling water is evaporated in a water jacket and the vapor is introduced in condenser tubes to be condensed therein, is more advantageous than a circulation cooling system in saving the amount of cooling water by the function of the latent heat of evaporization.

However, the former is disadvantageous in loss of water when the cooling efficiency is low.

In order to reduce the loss of water, an improved closed evaporative cooling system for a small horizontal engine disclosed in Japanese Utility Model Publication No. 44-28,022 comprises an auxiliary tank disposed at one side of a condenser, and a pipe communicating the auxiliary tank with an upper tank of the condenser, and a pressure valve fixed at the upper part of the auxiliary tank, so as to cool and condense vapor from the upper tank in the pipe, and to reserve condensed water in the auxiliary tank.

The improved system described above may reduce the loss of cooling water as a whole. However, it implies that cooling water will be transfused to the auxiliary tank and decreasing the water in the water jacket for sufficient cooling after a long running of the engine. And the temperature, at which vapor begins to condense in condenser tubes, is depressed by the depression of the internal pressure of the upper tank as a result of the condensation of vapor in the pipe communicating between the two tanks. As a result of depression of the condensation point and internal pressure in the upper tank, vapor begins to condense at the higher position in condenser tubes, and condensed water begins to fall along the internal surface of the tubes. The volume of condensed water in each tube increases as soon as the condensed water begins to fall along the internal periphery of each tube by adsorbing dewdrops of vapor rising therethrough successively, and condensed water closes the internal passages of the tubes at their higher position. Thus, water condensed in the tubes may be easily and frequently spit into the upper tank by the pressure of vapor in the water jacket, accompanying small and shocking pulsation of pressure, and the brazed or soldered part between the upper end of each tube and the lower wall of the upper tank is repeatedly and alternatively expanded by heat of vapor and contracted by coolness of water spit therethrough, in such high frequency as three times per a minute, for example. Due to the alternation of expansion and contraction, an alternative thermal stress acts on the brazed or soldered part to bring on the fracture thereof from fatigue of brazing or soldering materials.

SUMMARY OF THE INVENTION

Therefore, the primary object of the invention is to prolong the life of the condenser by reducing thermal stress acting on the brazed or soldered part between the upper end of each condenser tube and the bottom plate of the upper tank.

The other object of the invention is to reduce the loss of cooling water from the water jacket for a long time.

To this end, the closed evaporative cooling system for an engine, according to the present invention, comprising a water jacket having an top opening formed through an upper wall of said engine, a condenser having an upper tank, a bottom plate and condenser tubes, a seat formed around said upside opening for fixing said bottom plate of said condenser thereon, a pressure regulating valve for regulating internal pressure of said upper tank, each of said tube has an upper end penetrating through the bottom wall of said upper tank and brazed or soldered thereto, and a lower end penetrating through said bottom late and brazed or soldered thereto respectively, wherin; the improvement comprises a damper pipe for damping the variation of internal pressure of said upper tank, having one end communicated with said upper tank of said condenser fixed on the upper in the upper part of said water jacket of said engine and another end communicated with said pressure regulating valve.

The damper pipe damps the variation of internal pressure of the upper tank, while the mean internal pressure is transmitted to the pressure regulating valve. And the valve is inactive in response to any small and shocking variation or pulsaion of the internal pressure in the tank. Consequntly, the mean internal pressure accumulated in the upper tank is kept higher than that of the known system. As the result, vapor begins to condense at higher temperature and at the lower position in the condenser tubes, so that, condensed water adsorbs only a few amount of dewdrops in vapor before it will fall off from the tubes, and that the volume of condensed water is not grown to close the internal passage of each tube. Therefore, on the one hand, condensed water is hardly spit into the upper tank and the brazed or soldered part between the upper end of each tube and the lower wall of upper tank does not receive alternative thermal load, so that, the part is prevented from fracture from thermal stress for a long time. And on the other hand, as condensed water does not close the internal passage of the condenser tubes, and as condensation of vapor occurs at the lower position in each condenser tube, water is returned smoothly and quickly to the water jacket, so that, the loss of cooling water from the water jacket is reduced almost all and the fall of cooling efficiency from the depression of water surface is prevented for a long time.

the damper pipe is preferably formed long and narrow, and possiblly, the damper pipe may be provided with a restriction in the way thereof, in order to obtain higher performance in damping.

The damper pipe is preferably made of adiabatic nonmetallic materials to prevent condensation of vapor therein.

It is obserbed in cold season that the pressure regulating valve is stuck in closed position by ice of condensed water frozen therein, and that the internal pressure in the condenser is raised to threaten it with damage from abnormal compression therein. Therefore, it is advantageous to dispose the pressure regulating valve on the outer shell, preferably on the upper wall, of the engine so as to transmit the heat generated by the engine to the valve for defrosting of ice therin.

BRIEF DESCRIPTION OF THE DRAWINGS

The invention may be understood more clearly and precisely upon reading the following description of the invention, which refers to the attached drawings, wherein like members or parts are designated with the same reference numeral, and wherein.

DETAILED DESCRIPTION OF THE PREFERRED EMBODIMENTS

Figure 2:
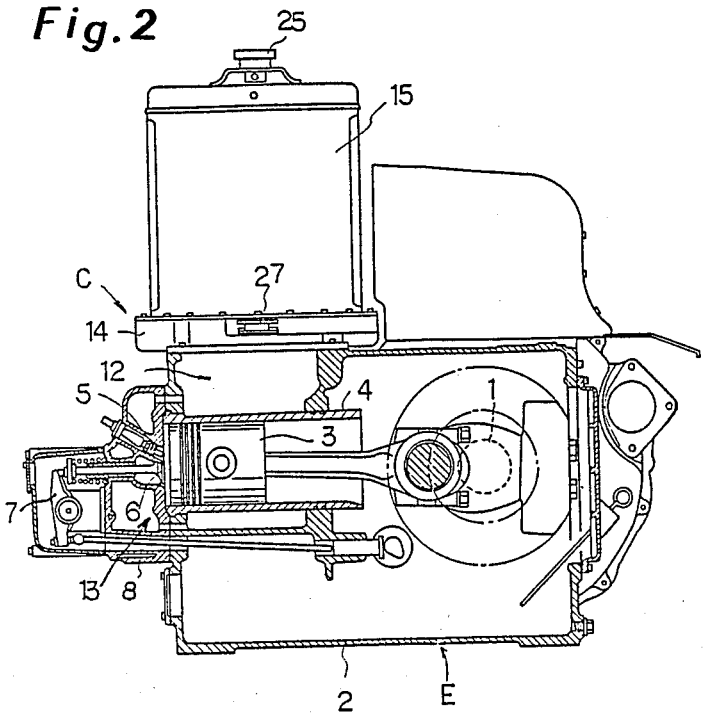
FIG. 2 is a vertical section of a gas engine with a closed evapolating cooling system according to the present invention.

Now, referring to the FIG. 2, an engine body E has a crank shaft 1, a crank case 2 which supports the crank shaft 1, a cylinder 4 formed in the crank case 2 at the contrary side of the crank shaft 1, a piston 3 slidably inserted in the cylinder 4, a cilinder head 8 which is provided with an ignition plug 5, a set of intake and exhaust valves 6, and rocker arms 7, fixed to the outside of the cylinder 4. And the engine is provided with a flywheel 9 fixed at one end of the crank shaft 1, an air cleaner 10, a muffler 11, and a closed evaporating cooling system C as the accessories.

A water jacket 12 is formed around the cylinder 4 in the crank case 2, and communicates with another water jacket 13 formed in the cylinder head 8. As seen in FIGS. 1 to 4, the water jacket 12 is open at the upper surface of the crank case 2, and a hollow base member 14, which constitutes part of the upper wall, namely, a part of the outer shell of the engine body E, is fixed on the upper surface of crank case 2 so as to cover this top opening of the crank case 2, and to support a condenser 15 thereon.

The bottom wall of the base member 14 is cut at the front side to communicate the interior thereof with the water jacket 12, and the top wall is provided with a top opening 17 at the rear side thereof and a seat 16 for condenser 15, on which the bottom plate 18 of the condenser 15 is fixed, at the top surface thereof around the opening 17, so as to prevent direct invasion of boiling water from the water jacket 12 to the condenser 15, bottom wall of the member 14 functioning as a buffer plate.

The condenser 15 is adapted to have vapor introduced from the inside cavity of the base member 14 into the finned condenser tubes 19, and to condense it by cooling wind from a fan 21 as vapor passes from the internal cavity of the base member 14 to the upper tank 20 along the tubes 19, while the condensed water is returned through the tubes 19 to the water jacket 12.

The system C according to the present invention, further comprises the following elements in addition to the fundamental features described above.

Figure 1:
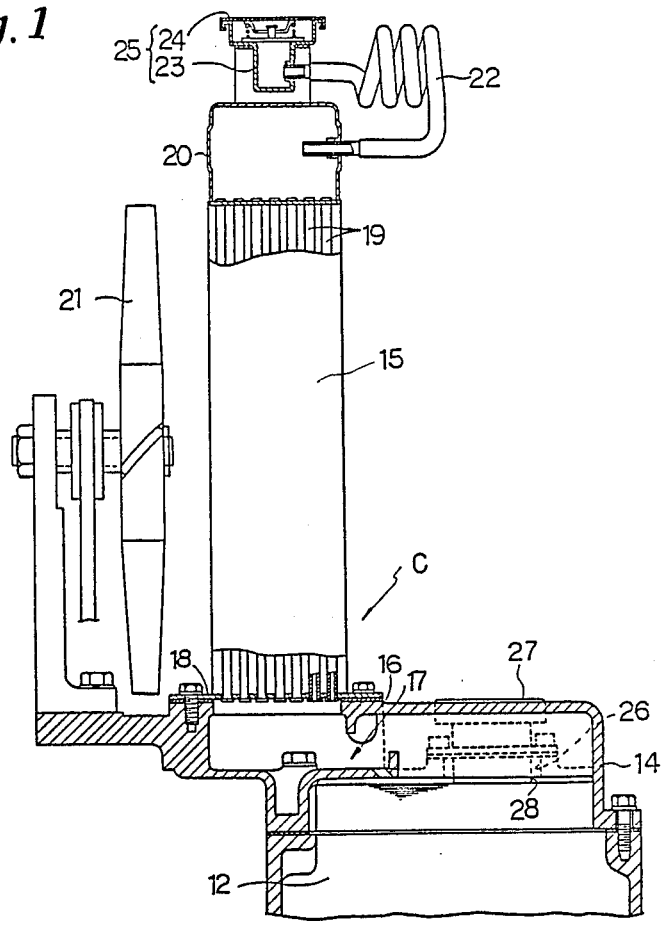
FIG. 1 is a vertical sectioned fragmentary side view of a preferred embodiment according to the present invention.

As seen in FIG. 1, the system according to the present invention comprises a damper pipe 22 leads from and communicates with the upper tank 20, and a pressure regulating valve 25 comprising a bottomed cylindrical receptacle 23 supported on the upper tank 20 and a pressure regulating cap 24 which closes the opening of the receptacle 23, which valve 25 communicates with the upper tank 20 by means of the damper pipe 22. The damper pipe 22 is made of coiled narrow pipe so as to form a long and narrow passage therein.

A filling port 26 is disposed on the base member 14 and is closed by another pressure regulating valve 27 the pressure setting of which is higher than that of valve 25. And a measuring pipe 28 is positioned under the filling port 26 for setting the level of water in the water jacket 12.

According to the preferred embodiment described above, the pulsation or variation of internal pressure in the upper tank 20 is damped while mean internal pressure in the upper tank 20 is transmitted to the pressure regulating valve 25 through the pipe 22. Thus, the valve 25 is not opened by any small and shocking pulsation of pressure in the upper tank 20, and the mean internal pressure in the upper tank 20 is accurately regulated at the setting pressure of the pressure regulating valve 25. Therefore, a sufficiently high pressure is accumulated in the condenser 15, and the temperature, at which vapor begins to condense, is raised. Cosequently, the condensation efficiency of vapor in the condenser 15 is improved, and the leakage of vapor through the pressure regulating valve 25 is substantially eliminated.

It was observed through comparative experiments wherein the volume of cooling water overflowed or evaporated from the condenser was metered in either hours of engine running starting with a full tank of cooling water with liquid anti-freezing agent of 20%, at atmospheric temperature of 45° C., using a gas engine of 13.5 PS and 1900 cc, that the reduction of cooling water from the water jacket is substantially zero for the system according to the invention, while it was 2042 c.c. for the system with a different condenser which had a cap with a pin hole communicating the upper tank 20 with atmosphere, instead of pressure regulating cap 24.

Figure 4:
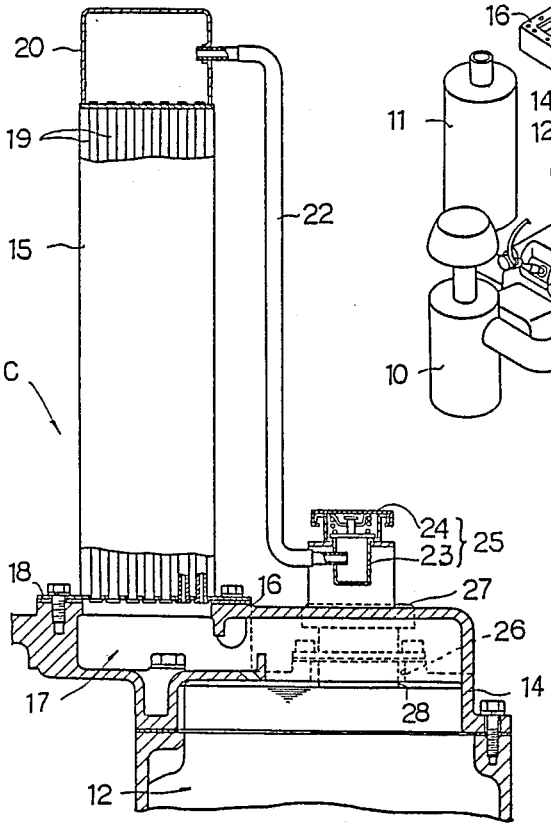
FIG. 4 is a vertical sectioned fragmentary side view of a different preferred embodiment according to the present invention, corresponding to the FIG. 1.

In a different preferred embodiment according to the present invention, as seen in FIG. 4, the pressure regulating valve 25 communicating with the upper tank 20 of the condenser 15 is supported on the base member 14 at its top surface, so as to transmit heat generated by engine to the valve 25. The damper pipe 22 is extends along the condenser tubes 19 on the side opposite to the fan 21 which sends cooling wind to the condenser 15.

Figure 3:
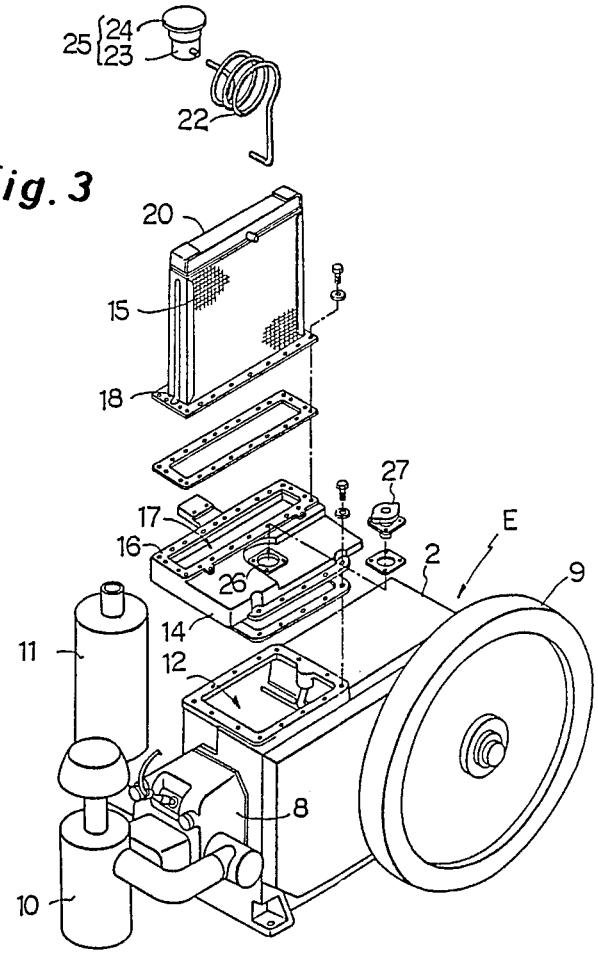
FIG. 3 is a perspective detail of a closed evaporative cooling system according to the present invention.

The other elements of this embodiment are equivalent to those of the previous embodiment shown in FIGS. 1 to 3. And the same results were experienced in the comparative experiments carried in the same manner as described above.

In this embodiment, the pressure regulating valve 25 is heated by the heat generated by and transmitted from the engine. If the valve is stuck because of ice formed from condensed water therein at the cold start of engine, the ice will be defrosted, and the valve will function normally as soon as the engine becomes warm after its start, before the internal pressure of the condenser is raised by evaporation of cooling water.

Figure 5:
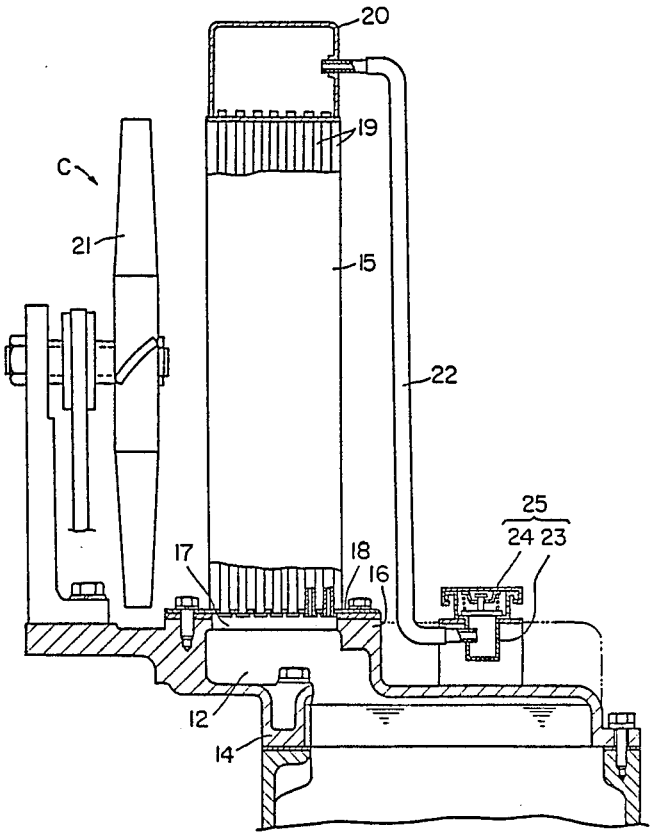
FIG. 5 is a vertical sectional fragmentary side view of yet another preferred embodiment according to the present invention, corresponding to the FIGS. 1 and 4.

In another different preferred embodiment illustrated in FIG. 5, a pressure regulating valve 25 communicates with the upper tank 20 of the condenser 15 by a damper pipe 22 supported on the top wall of the base member 14 in a depression which is influenced sooner than the higher location of the member 14 by the heat of cooling water and outer shell of the engine 15 body E. The other elements are equivalent to those of the previous embodiment shown in FIGS. 4. And the same result was experienced in the comparative experiments also carried in the same manner as described above.

In this embodiment, the pressure regulating valve 25 may be defrosted more quickly than the aforementioned system shown in FIG. 4.

The invention will not be limited in those embodiments descrived above, but includes all the variants and modified embodiments obvious to those skilled in the art within the spirits and scope of the follwing claims.

For example, the damper pipe may be provided with a restriction between the tank 20 and the valve 25. In case the damper pipe 22 is made of adiabatic non-metallic materials, the inside of the damper pipe 22 is not as chilled by atmosphere that condensation of vapor and depression of pressure may occur therein. Therefore, it is possible to keep the internal pressure of the condenser 15 sufficiently high.

What is claimed is:

1. A closed evaporative cooling system for an engine having a water jacket, comprising:

(a) a condenser having a plurality of condenser pipes therein and an upper tank located above said condenser pipes, said condenser being vertically mounted on and fixed to an upper portion of the water jacket and above the level of water in the water jacket, said upper tank communication with an air space above the water level in the water jacket only through the condenser pipes, and (b) a damper pipe having one end connected to and communicating with said upper tank and another end directly with a pressure regulating valve, said pressure regulating valve being supported by an outer shell of said engine.

2. A closed evaporative cooling system recited in claim 1, wherein said damper pipe is long and narrow.

3. A closed evaporative cooling system recited in claim 1, wherein said damper pipe is provided with a restriction in the way thereof.

4. A closed evaporative cooling system recited in claim 1, wherein said damper pipe is made of adiabatic non metallic materials.

* * * * *